US010271615B2

(12) United States Patent
Cross

(10) Patent No.: US 10,271,615 B2
(45) **Date of Patent: *Apr. 30, 2019**

(54) SOLE STRUCTURE WITH HOLES ARRANGED IN AUXETIC CONFIGURATION

(71) Applicant: NIKE, Inc., Beaverton, OR (US)

(72) Inventor: Tory M. Cross, Portland, OR (US)

(73) Assignee: NIKE, Inc., Beaveron, OR (US)

( * ) Notice: Subject to any disclaimer, the term of this patent is extended or adjusted under 35 U.S.C. 154(b) by 149 days.

This patent is subject to a terminal disclaimer.

(21) Appl. No.: 15/398,750

(22) Filed: Jan. 5, 2017

(65) Prior Publication Data

US 2017/0112235 A1 Apr. 27, 2017

Related U.S. Application Data

(63) Continuation of application No. 14/643,121, filed on Mar. 10, 2015, now Pat. No. 9,538,811, which is a (Continued)

(51) Int. Cl.
*A43B 13/28* (2006.01)
*A43B 1/00* (2006.01)

(Continued)

(52) U.S. Cl.
CPC ..... *A43B 13/28* (2013.01); *A43B 1/0009* (2013.01); *A43B 3/0073* (2013.01); *A43B 5/00* (2013.01);

(Continued)

(58) Field of Classification Search
CPC ..... A63C 13/003; A63C 13/006; A43C 15/00; A43C 15/02; A43C 15/065; A43C 15/068;

(Continued)

(56) References Cited

U.S. PATENT DOCUMENTS 7,797,856 B2 * 9/2010 Andrews ..... A43B 13/12 36/25 R
7,910,193 B2 * 3/2011 Ma ..... A47C 23/002 428/218

(Continued)

FOREIGN PATENT DOCUMENTS

CN 2620494 Y 6/2004
CN 102958394 A 3/2013

(Continued)

OTHER PUBLICATIONS https://spacesymmetrystructure.wordpress.com/2012/10/15/variation-from-uniformity/, Daniel,VAriation from Uniformity, Oct. 15, 2012.*

*Primary Examiner* — Shaun R Hurley
*Assistant Examiner* — Bao-Thieu L Nguyen
(74) *Attorney, Agent, or Firm* — Quinn IP Law

(57) ABSTRACT

An article of footwear includes a midsole component and an outer sole member. The midsole component has an inner surface and an outer surface, and including a plurality of holes extending from the outer surface. The plurality of holes are arranged to provide the midsole component with an auxetic configuration. The plurality of holes includes a plurality of through holes, each extending through the midsole component and through both the inner surface and the outer surface, and at least one blind hole. The outer sole member is affixed to the midsole component and includes a blind hole extending from the outer surface.

16 Claims, 11 Drawing Sheets

Related U.S. Application Data continuation-in-part of application No. 14/030,002, filed on Sep. 18, 2013, now Pat. No. 9,402,439.

(51) Int. Cl.

| | |
|---|---|
| ***A43B 3/00*** | (2006.01) |
| ***A43B 5/00*** | (2006.01) |
| ***A43B 13/02*** | (2006.01) |
| ***A43B 13/12*** | (2006.01) |
| ***A43B 13/18*** | (2006.01) |
| ***A43B 13/14*** | (2006.01) |
| ***A43B 13/38*** | (2006.01) |

(52) U.S. Cl.
CPC ..... *A43B 13/02* (2013.01); *A43B 13/122* (2013.01); *A43B 13/125* (2013.01); *A43B 13/14* (2013.01); *A43B 13/141* (2013.01); *A43B 13/181* (2013.01); *A43B 13/186* (2013.01); *A43B 13/187* (2013.01); *A43B 13/188* (2013.01); *A43B 13/38* (2013.01)

(58) Field of Classification Search
CPC ..... A43B 13/02; A43B 13/181; A43B 13/187; A43B 13/188; A43B 13/122; A43B 1/0009; A43B 5/00
See application file for complete search history.

(56) References Cited

U.S. PATENT DOCUMENTS 8,084,117 B2 * 12/2011 Lalvani ..... B32B 3/266 428/135
8,209,883 B2 * 7/2012 Lyden ..... A43B 1/0081 2/239
8,544,515 B2 * 10/2013 Ma ..... B60C 7/14 152/151
8,883,287 B2 * 11/2014 Boyce ..... B29C 59/02 174/254
9,538,811 B2 * 1/2017 Cross ..... A43B 13/02
9,554,620 B2 * 1/2017 Cross ..... B32B 27/065
2007/0122590 A1 5/2007 Lalvani
2009/0064536 A1 * 3/2009 Klassen ..... A43B 13/181 36/27
2010/0095551 A1 * 4/2010 Gupta ..... A43B 7/144 36/29
2010/0293815 A1 * 11/2010 Ferrigan ..... A43B 3/0042 36/25 R
2010/0330330 A1 * 12/2010 Luca ..... B29C 44/5654 428/137
2013/0322955 A1 * 12/2013 Ma ..... E04B 1/1903 403/53
2014/0090271 A1 * 4/2014 Hoffer ..... A43B 1/0009 36/29
2014/0154452 A1 6/2014 Kim
2015/0289584 A1 * 10/2015 Nurse ..... A43B 3/0031 36/89

FOREIGN PATENT DOCUMENTS

KR 20120111841 A 10/2012
TW 201012407 A 4/2010
TW 201110897 A 4/2011

* cited by examiner

SOLE STRUCTURE WITH HOLES ARRANGED IN AUXETIC CONFIGURATION

CROSS-REFERENCE TO RELATED APPLICATIONS

This application is a Continuation of U.S. patent application Ser. No. 14/643,121, filed 10 Mar. 2015 and published as U.S. Patent Publication No. US 2015/0245686, which is a Continuation-in-Part of U.S. patent application Ser. No. 14/030,002, filed on 18 Sep. 2013 and issued as U.S. Pat. No. 9,402,439. The disclosure of both applications is hereby incorporated by reference in their entirety.

BACKGROUND

The present embodiments relate generally to articles of footwear, and in particular to articles of footwear with uppers and sole structures.

Articles of footwear generally include two primary elements: an upper and a sole structure. The upper may be formed from a variety of materials that are stitched or adhesively bonded together to form a void within the footwear for comfortably and securely receiving a foot. The sole structure is secured to a lower portion of the upper and is generally positioned between the foot and the ground. In many articles of footwear, including athletic footwear styles, the sole structure often incorporates an insole, a midsole, and an outsole.

SUMMARY

In one aspect, an article of footwear includes a midsole component having an inner surface and an outer surface. The midsole component includes a plurality of holes arranged in an auxetic configuration in the outer surface. The plurality of holes includes a first hole and a second hole. The first hole is a through hole that extends from the outer surface to the inner surface and the second hole is a blind hole.

An article of footwear includes a midsole component with an inner surface and an outer surface. The midsole component further includes a lower portion and a sidewall portion. The midsole component includes a plurality of holes arranged in an auxetic configuration in the outer surface. At least one hole in the plurality of holes includes a hole portion that is disposed in the sidewall portion of the midsole component.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
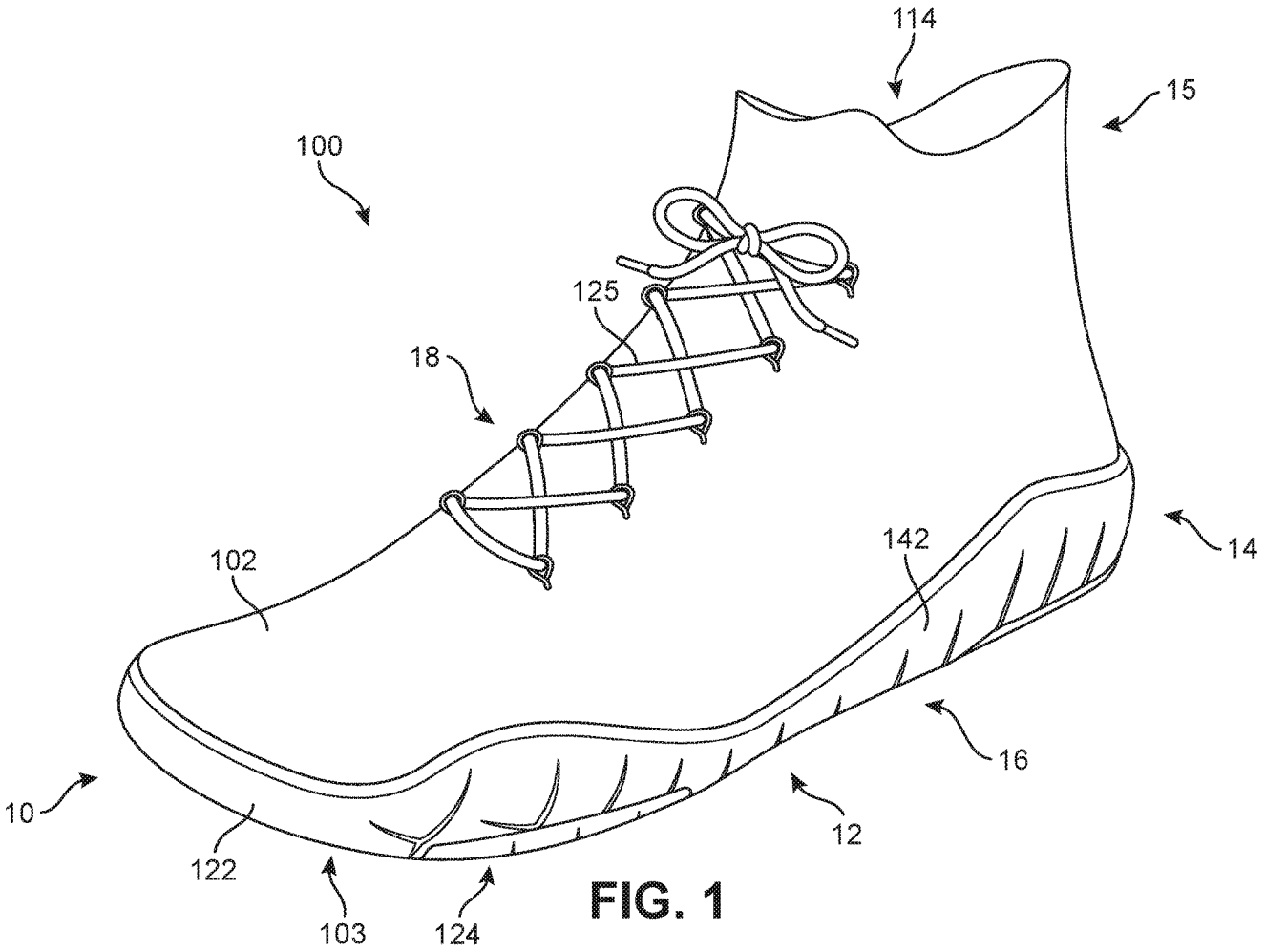
FIG. 1 is an isometric view of an embodiment of an article of footwear.

FIG. 1 is an isometric view of an embodiment of an article of footwear 100. In the exemplary embodiment, article of footwear 100 has the form of an athletic shoe. However, in other embodiments, the provisions discussed herein for article of footwear 100 could be incorporated into various other kinds of footwear including, but not limited to: basketball shoes, hiking boots, soccer shoes, football shoes, sneakers, running shoes, cross-training shoes, rugby shoes, baseball shoes as well as other kinds of shoes. Moreover, in some embodiments, the provisions discussed herein for article of footwear 100 could be incorporated into various other kinds of non-sports related footwear, including, but not limited to: slippers, sandals, high heeled footwear, and loafers.

For purposes of clarity, the following detailed description discusses the features of article of footwear 100, also referred to simply as article 100. However, it will be understood that other embodiments may incorporate a corresponding article of footwear (e.g., a right article of footwear when article 100 is a left article of footwear) that may share some, and possibly all, of the features of article 100 described herein and shown in the figures.

The embodiments may be characterized by various directional adjectives and reference portions. These directions and reference portions may facilitate in describing the portions of an article of footwear. Moreover, these directions and reference portions may also be used in describing sub-components of an article of footwear (e.g., directions and/or portions of an inner sole component, a midsole component, an outer sole component, an upper or any other components).

For consistency and convenience, directional adjectives are employed throughout this detailed description corresponding to the illustrated embodiments. The term "longitudinal" as used throughout this detailed description and in the claims refers to a direction extending a length of a component (e.g., an upper or sole component). In some cases, the longitudinal direction may extend from a forefoot portion to a heel portion of the component. Also, the term "lateral" as used throughout this detailed description and in the claims refers to a direction extending along a width of a component. In other words, the lateral direction may extend between a medial side and a lateral side of a component. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. Additionally, the term "inner" refers to a portion of an article disposed closer to an interior of an article, or closer to a foot when the article is worn. Likewise, the term "outer" refers to a portion of an article disposed further from the interior of the article or from the foot. Thus, for example, the inner surface of a component is disposed closer to an interior of the article than the outer surface of the component. This detailed description makes use of these directional adjectives in describing an article and various components of the article, including an upper, a midsole structure and/or an outer sole structure.

Article 100 may be characterized by a number of different regions or portions. For example, article 100 could include a forefoot portion, a midfoot portion, a heel portion and an ankle portion. Moreover, components of article 100 could likewise comprise corresponding portions. Referring to FIG. 1, article 100 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. Article 100 may also include an ankle portion 15 (which may also be referred to as a cuff portion). In addition, article 100 may include lateral side 16 and medial side 18. In particular, lateral side 16 and medial side 18 may be opposing sides of article 100. Furthermore, both lateral side 16 and medial side 18 may extend through forefoot portion 10, midfoot portion 12, heel portion 14 and ankle portion 15.

Figure 2:
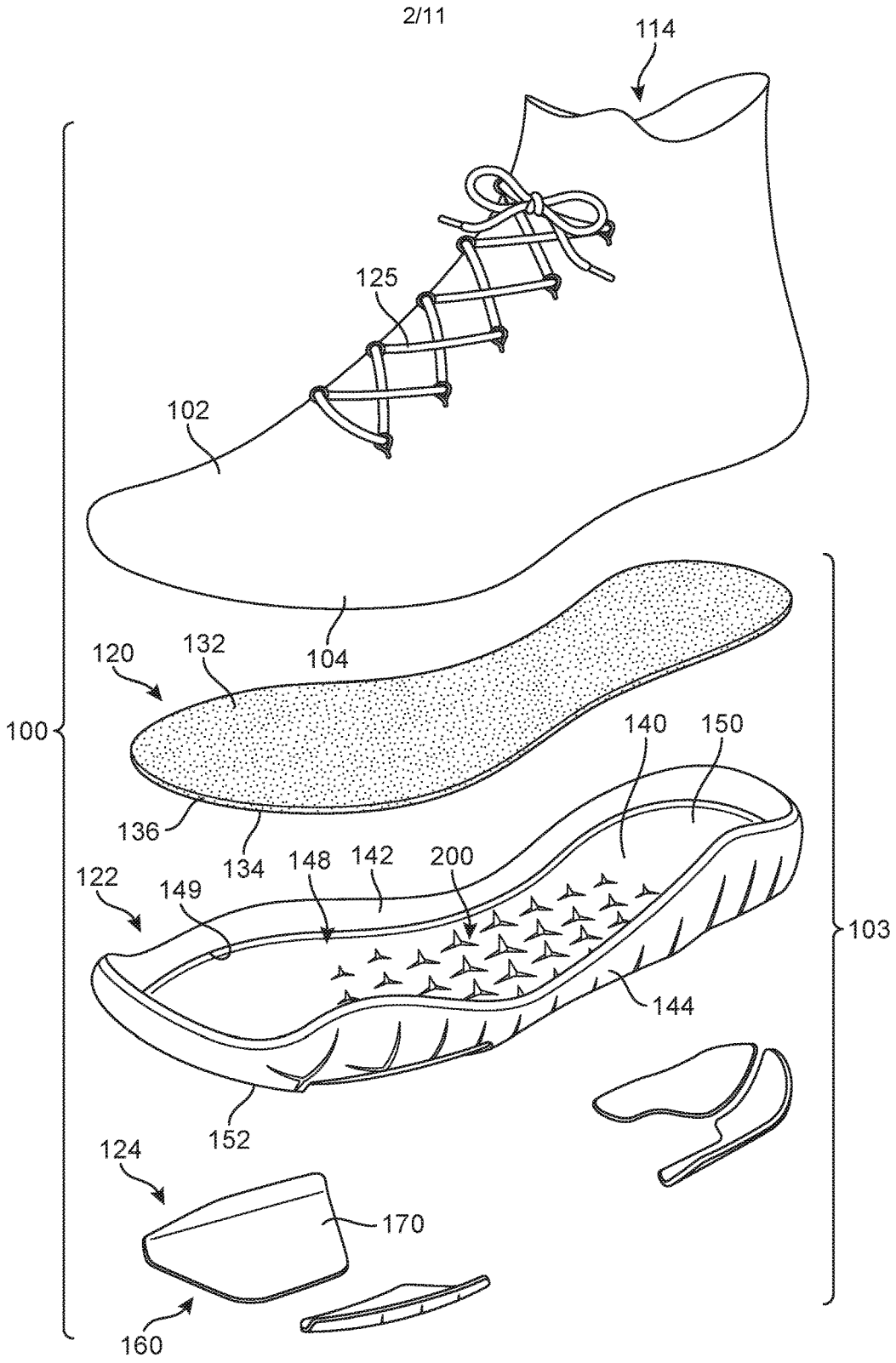
FIG. 2 is an exploded isometric view of an embodiment of an article of footwear, including a sole structure comprised of an inner sole component, a midsole component and a plurality of outer sole members.

FIG. 2 illustrates an exploded isometric view of an embodiment of article of footwear 100. FIGS. 1-2 illustrate various components of article of footwear 100, including an upper 102 and a sole structure 103.

Generally, upper 102 may be any type of upper. In particular, upper 102 may have any design, shape, size and/or color. For example, in embodiments where article 100 is a basketball shoe, upper 102 could be a high top upper that is shaped to provide high support on an ankle. In embodiments where article 100 is a running shoe, upper 102 could be a low top upper.

In some embodiments, upper 102 includes opening 114 that provides entry for the foot into an interior cavity of upper 102. In some embodiments, upper 102 may also include a tongue (not shown) that provides cushioning and support across the instep of the foot. Some embodiments may include fastening provisions, including, but not limited to: laces, cables, straps, buttons, zippers as well as any other provisions known in the art for fastening articles. In some embodiments, a lace 125 may be applied at a fastening region of upper 102.

Some embodiments may include uppers that extend beneath the foot, thereby providing 360 degree coverage at some regions of the foot. However, other embodiments need not include uppers that extend beneath the foot. In other embodiments, for example, an upper could have a lower periphery joined with a sole structure and/or sock liner.

An upper could be formed from a variety of different manufacturing techniques resulting in various kinds of upper structures. For example, in some embodiments, an upper could have a braided construction, a knitted (e.g., warp-knitted) construction or some other woven construction. In an exemplary embodiment, upper 102 may be a knitted upper.

In some embodiments, sole structure 103 may be configured to provide traction for article 100. In addition to providing traction, sole structure 103 may attenuate ground reaction forces when compressed between the foot and the ground during walking, running or other ambulatory activities. The configuration of sole structure 103 may vary significantly in different embodiments to include a variety of conventional or non-conventional structures. In some cases, the configuration of sole structure 103 can be configured according to one or more types of ground surfaces on which sole structure 103 may be used. Examples of ground surfaces include, but are not limited to: natural turf, synthetic turf, dirt, hardwood flooring, as well as other surfaces.

Sole structure 103 is secured to upper 102 and extends between the foot and the ground when article 100 is worn. In different embodiments, sole structure 103 may include different components. In the exemplary embodiment shown in FIGS. 1-2, sole structure 103 may include inner sole component 120, midsole component 122 and a plurality of outer sole members 124. In some cases, one or more of these components may be optional.

Referring now to FIG. 2, in some embodiments, inner sole component 120 may be configured as an inner layer for a midsole. For example, as discussed in further detail below, inner sole component 120 may be integrated, or received, into a portion of midsole component 122. However, in other embodiments, inner sole component 120 could function as an insole layer and/or as a strobel layer. Thus, in at least some embodiments, inner sole component 120 could be joined (e.g., stitched or glued) to lower portion 104 of upper 102 for purposes of securing sole structure 103 to upper 102.

Inner sole component 120 may have an inner surface 132 and an outer surface 134. Inner surface 132 may generally be oriented towards upper 102. Outer surface 134 may be generally oriented towards midsole component 122. Furthermore, a peripheral sidewall surface 136 may extend between inner surface 132 and outer surface 134.

Midsole component 122 may be configured to provide cushioning, shock absorption, energy return, support, as well as possibly other provisions. To this end, midsole component 122 may have a geometry that provides structure and support for article 100. Specifically, midsole component 122 may be seen to have a lower portion 140 and a sidewall portion 142. Sidewall portion 142 may extend around the entire periphery 144 of midsole component 122. As seen in FIG. 1, sidewall portion 142 may partially wrap up the sides of article 100 to provide increased support along the base of the foot.

Midsole component 122 may further include an inner surface 150 and an outer surface 152. Inner surface 150 may be generally oriented towards upper 102, while outer surface 152 may be oriented outwardly. Furthermore, in the exemplary embodiment, midsole component 122 includes a central recess 148 disposed in inner surface 150. Central recess 148 may generally be sized and configured to receive inner sole component 120.

In some embodiments, midsole component 122 may include a plurality of holes 200, at least some of which may extend through the entire thickness of midsole component 122. In the exemplary embodiment shown in FIG. 2, some of the plurality of holes 200 are visible within central recess 148.

In different embodiments, midsole component 122 may generally incorporate various provisions associated with midsoles. For example, in one embodiment, a midsole component may be formed from a polymer foam material that attenuates ground reaction forces (i.e., provides cushioning) during walking, running, and other ambulatory activities. In various embodiments, midsole components may also include fluid-filled chambers, plates, moderators, or other elements that further attenuate forces, enhance stability, or influence the motions of the foot, for example.

Figure 3:
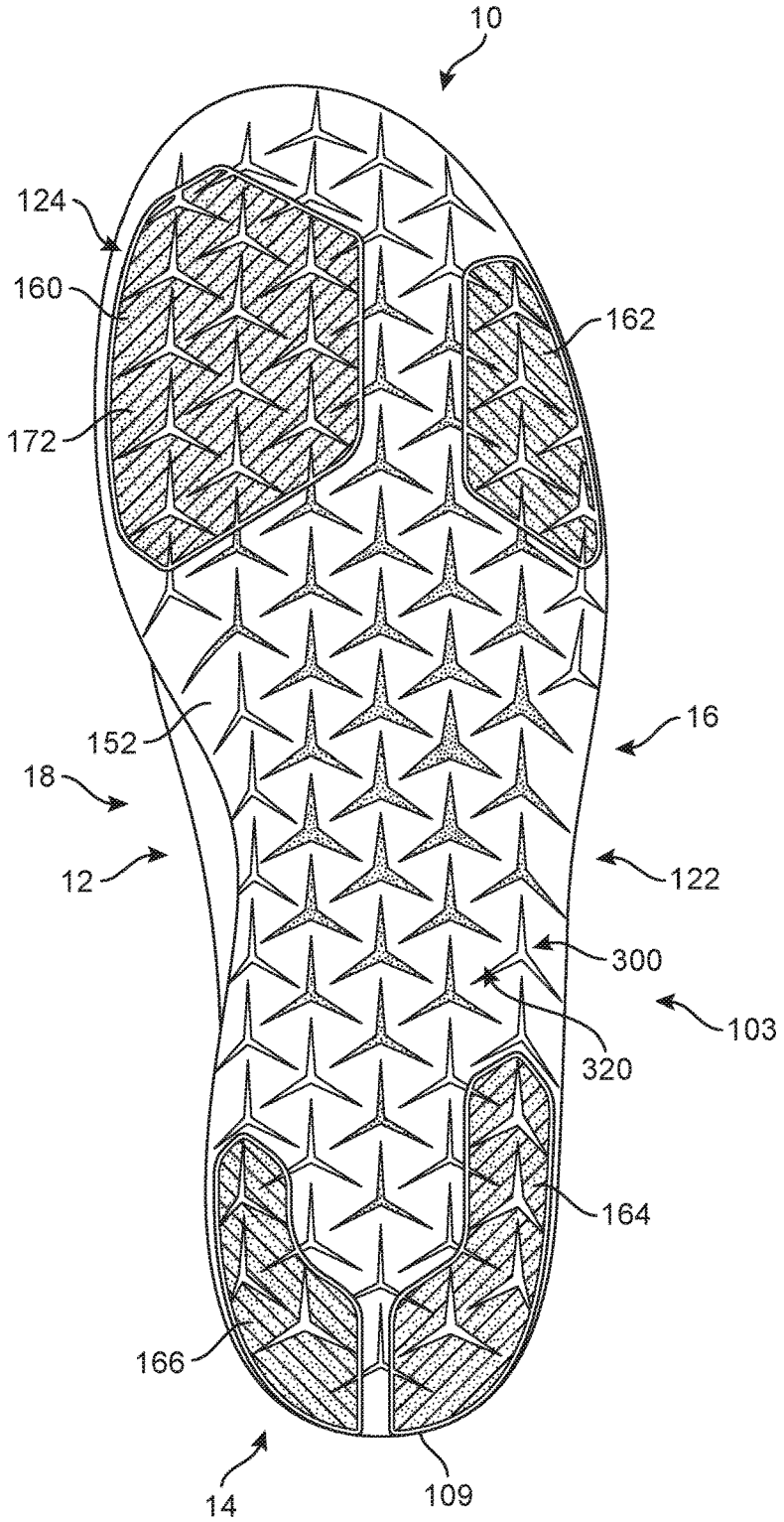
FIG. 3 is a bottom view of an embodiment of an article of footwear.

FIG. 3 illustrates a bottom view of sole structure 103. As seen in FIGS. 2-3, plurality of outer sole members 124 comprises four distinct outer sole members. Specifically, sole structure 103 includes a first outer sole member 160, a second outer sole member 162, a third outer sole member 164 and a fourth outer sole member 166. Although the exemplary embodiment includes four different outer sole members, other embodiments could include any other number of outer sole members. In another embodiment, for example, only a single outer sole member may be present. In still another embodiment, only two outer sole members may be used. In still another embodiment, only three outer sole members could be used. In still other embodiments, five or more outer sole members could be used.

Generally, an outer sole member may be configured as a ground contacting member. In some embodiments, an outer sole member could include properties associated with outsoles, such as durability, wear-resistance and increased traction. In other embodiments, an outer sole member could include properties associated with a midsole, including cushioning, strength and support. In the exemplary embodiment, plurality of outer sole members 124 may be configured as outsole-like members that enhance traction with a ground surface while maintaining wear resistance.

In different embodiments, the locations of one or more outer sole members could vary. In some embodiments, one or more outer sole members could be disposed in a forefoot portion of a sole structure. In other embodiments, one or more outer sole members could be disposed in a midfoot portion of a sole structure. In still other embodiments, one or more outer sole members could be disposed in a heel portion of a sole structure. In an exemplary embodiment, first outer sole member 160 and second outer sole member 162 may be disposed in forefoot portion 10 of sole structure 103. More specifically, first outer sole member 160 may be disposed on medial side 18 of forefoot portion 10, while second outer sole member 162 may be disposed on lateral side 16 of forefoot portion 10. In addition, in the exemplary embodiment third outer sole member 164 and fourth outer sole member 166 may be disposed in heel portion 14 of sole structure 103. More specifically, third outer sole member 164 may be disposed on lateral side 16 and fourth outer sole member 166 may be disposed on medial side 18. Furthermore, it can be seen that first outer sole member 160 and second outer sole member 162 are spaced apart from one another in the center of forefoot portion 10, while third outer sole member 164 and fourth outer sole member 166 are spaced apart from one another in the center of heel portion 14. This exemplary configuration provides outer sole members at areas of increased ground contact during various lateral and medial cuts, so as to enhance traction during these motions.

The sizes of various outer sole members could vary. In the exemplary embodiment, first outer sole member 160 may be the largest outer sole member of plurality of outer sole members 124. Moreover, second outer sole member 162 may be substantially smaller than first outer sole member 160 thereby enhancing traction more on a medial side 18 of sole structure 103 than on lateral side 16 in forefoot portion 10. At heel portion 14, third outer sole member 164 and fourth outer sole member 166 are both widest along a rearward edge 109 of sole structure 103, and taper slightly towards midfoot portion 12.

Referring to FIGS. 2 and 3, first outer sole member 160 may be seen to have an inner surface 170 and an outer surface 172. Inner surface 170 may generally be disposed against midsole component 122. Outer surface 172 may face outwardly and may be a ground contacting surface. For purposes of clarity, only the inner and outer surfaces of first outer sole member 160 are indicated in FIGS. 2-3, however it will be understood that the remaining outer sole members may likewise include corresponding inner and outer surfaces that have similar orientations with respect to midsole component 122.

In the exemplary embodiment, inner sole component 120 may be disposed within central recess 148 of midsole component 122. More specifically, outer surface 134 of inner sole component 120 may be oriented towards, and be in contact with, inner surface 150 of midsole component 122. Furthermore, in some cases, peripheral sidewall surface 136 may also contact inner surface 150 along an inner recess sidewall 149. In addition, plurality of outer sole members 124 may be disposed against outer surface 152 of midsole component 122. For example, inner surface 170 of first outer sole member 160 may face towards, and be in contact with, outer surface 152 of midsole component 122. In some embodiments, when assembled, midsole component 122 and inner sole component 120 could comprise a composite midsole assembly, or dual layered midsole assembly.

In different embodiments, upper 102 and sole structure 103 could be joined in various ways. In some embodiments, upper 102 could be joined to inner sole component 120, e.g., using an adhesive or by stitching. In other embodiments, upper 102 could be joined to midsole component 122, for example, along sidewall portion 142. In still other embodiments, upper 102 could be joined with both inner sole component 120 and midsole component 122. Moreover, these components may be joined using any methods known in the art for joining sole components with uppers, including various lasting techniques and provisions (e.g., board lasting, slip lasting, etc.).

In different embodiments, the attachment configurations of various components of article 100 could vary. For example, in some embodiments, inner sole component 120 could be bonded or otherwise attached to midsole component 122. Such bonding or attachment could be accomplished using any known methods for bonding components of articles of footwear, including, but not limited to: adhesives, films, tapes, staples, stitching, or other methods. In some other embodiments, it is contemplated that inner sole component 120 may not be bonded or attached to midsole component 122, and instead could be free-floating. In at least some embodiments, inner sole component 120 may have a friction fit with central recess 148 of midsole component 122.

Outer sole members 124 may be likewise be bonded or otherwise attached to midsole component 122. Such bonding or attachment could be accomplished using any known methods for bonding components of articles of footwear, including, but not limited to: adhesives, films, tapes, staples, stitching, or other methods.

It is contemplated that in at least some embodiments, two or more of inner sole component 120, midsole component 122 and/or outer sole members 124 could be formed and/or bonded together during a molding process. For example, in some embodiments, upon forming midsole component 122, inner sole component 120 could be molded within central recess 148.

Embodiments can include provisions to facilitate expansion and/or adaptability of a sole structure during dynamic motions. In some embodiments, a sole structure may be configured with auxetic provisions. In particular, one or more components of the sole structure may be capable of undergoing auxetic motions (e.g., expansion and/or contraction).

Sole structure 103 as shown in FIGS. 1-5 and as described further in detail below, has an auxetic structure or configuration. Sole structures comprising auxetic structures are described in Cross, U.S. patent application Ser. No. 14/030,002, filed Sep. 18, 2013 and entitled "Auxetic Structures and Footwear with Soles Having Auxetic Structures" (the "Auxetic Structures application"), the entirety of which is hereby incorporated by reference.

Figure 4:
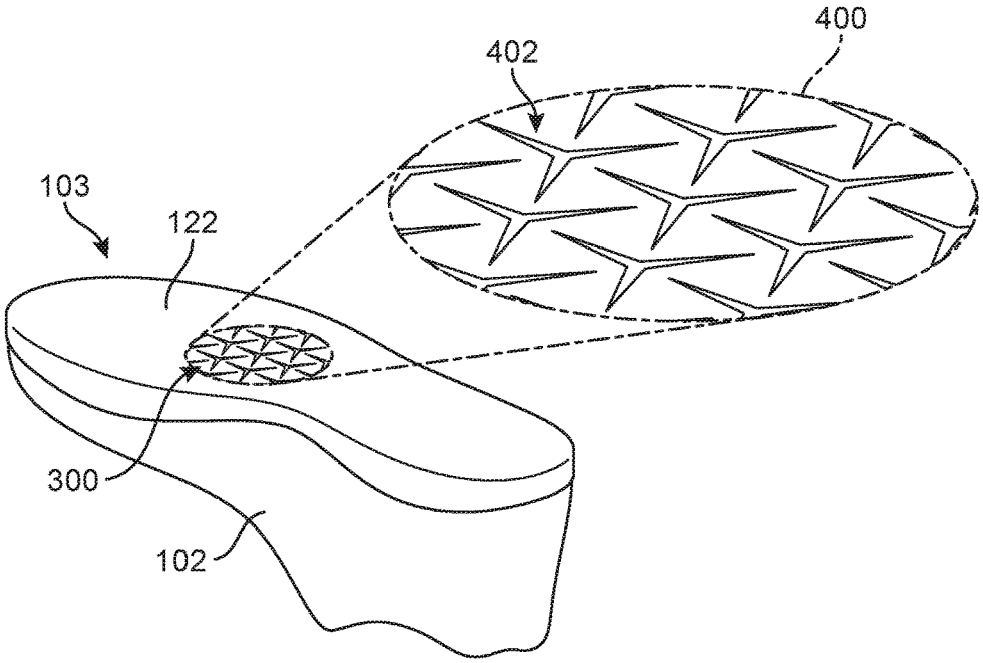
FIG. 4 is a bottom isometric view of an embodiment of a sole structure including an enlarged schematic view of a portion of the sole structure.
Figure 5:
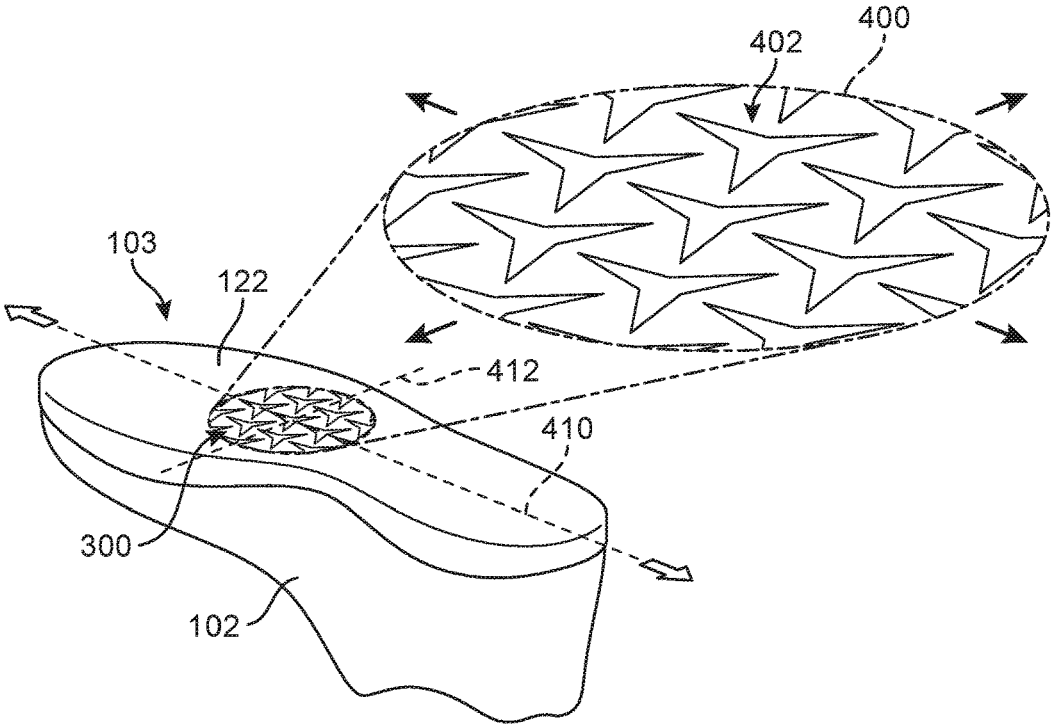
FIG. 5 is a bottom isometric view of an embodiment of a sole structure including an enlarged schematic view of a portion of the sole structure, in which the portion of the sole structure is undergoing auxetic expansion.

As described in the Auxetic Structures application, auxetic materials have a negative Poisson's ratio, such that when they are under tension in a first direction, their dimensions increase both in the first direction and in a second direction orthogonal or perpendicular to the first direction. This property of an auxetic material is illustrated in FIGS. 4 and 5.

As seen in FIG. 3, sole structure 103 may include a plurality of holes 300. As used herein, the term "hole" refers to any hollowed area or recessed area in a component. In some cases, a hole may be a through hole, in which the hole extends between two opposing surfaces of a component. In other cases, a hole may be a blind-hole, in which the hole may not extend through the entire thickness of the component and may therefore only be open on one side. Moreover, as discussed in further detail below, a component may utilize a combination of through holes and blind-holes. Furthermore, the term "hole" may be used interchangeably in some cases with "aperture" or "recess".

In regions including one or more holes, sole structure 103 may be further associate with a plurality of discrete sole portions 320. Specifically, sole portions 320 comprise the portions of sole structure 103 that extend between plurality of holes 300. It may also be seen that plurality of holes 300 extend between sole portions 320. Thus it may be understood that each hole may be surrounded by a plurality of sole portions, such that the boundary of each hole may be defined by the edges of the sole portions. This arrangement between holes (or apertures) and sole portions, is discussed in further detail in the Auxetic Structures application.

As seen in FIG. 3, plurality of holes 300 may extend through a majority of midsole component 122. In some embodiments, plurality of holes 300 may extend through forefoot portion 10, midfoot portion 12 and heel portion 14 of midsole component 122. In other embodiments, plurality of holes 300 may not extend through each of these portions.

Plurality of holes 300 may also extend through plurality of outer sole members 124. In the exemplary embodiment, each of first outer sole member 160, second outer sole member 162, third outer sole member 164 and fourth outer sole member 166 includes two or more holes. However, in other embodiments, one or more outer sole members may not include any holes.

In different embodiments, the geometry of one or more holes could vary. Examples of different geometries that could be used for an auxetic sole structure are disclosed in the Auxetic Structures application. Moreover, embodiments could also utilize any other geometries, such as utilizing sole portions with parallelogram geometries or other polygonal geometries that are arranged in a pattern to provide the sole with an auxetic structure. In the exemplary embodiment, each hole of plurality of holes 300 has a tri-star geometry, including three arms or points extending from a common center.

The geometry of one or more sole portions could also vary. Examples of different geometries that could be used for an auxetic sole structure are disclosed in the Auxetic Structures application. It may be understood that the geometry of a sole portion may be determined by the geometry of the holes in an auxetic pattern, and vice versa. In the exemplary embodiment, each sole portion has an approximately triangular geometry.

Plurality of holes 300 may be arranged on sole structure 103 in an auxetic pattern, or auxetic configuration. In other words, plurality of holes 300 may be arranged on midsole component 122 and/or outer sole members 124 in a manner that allows those components to undergo auxetic motions, such as expansion or contraction. An example of auxetic expansion, which occurs as the result of the auxetic configuration of plurality of holes 300, is shown in FIGS. 4 and 5. Initially, in FIG. 4, sole structure 103 is in a non-tensioned state. In this state, plurality of holes 300 have an untensioned area. For purposes of illustration, only a region 400 of midsole component 122 is shown, where region 400 includes a subset of holes 402.

As tension is applied across sole structure 103 along an exemplary linear direction 410 (e.g., a longitudinal direction), as shown in FIG. 5, sole structure 103 undergoes auxetic expansion. That is, sole structure 103 expands along direction 410, as well as in a second direction 412 that is perpendicular to direction 410. In FIG. 5, the representative region 400 is seen to expand in both direction 410 and direction 412 simultaneously, as holes 402 increase in size.

Embodiments can include provisions for varying the degree to which some portions of a sole structure (including portions of a midsole component and/or outer sole members) may undergo auxetic expansion. Because expansion of the sole structure may result in increased surface contact and/or increased flexibility for regions of the sole structure, varying the degree to which different regions or portions expand (or contract) under tension (or compression) may allow the traction properties and/or flexibility of those different regions to be tuned.

Varying the degree to which a midsole component undergoes auxetic expansion can be achieved by varying the properties of different openings. For example, embodiments of a midsole component may include some through holes and some blind holes, as through holes may generally expand more (relative to their initial configuration) than blind holes during auxetic motions.

Figure 6:
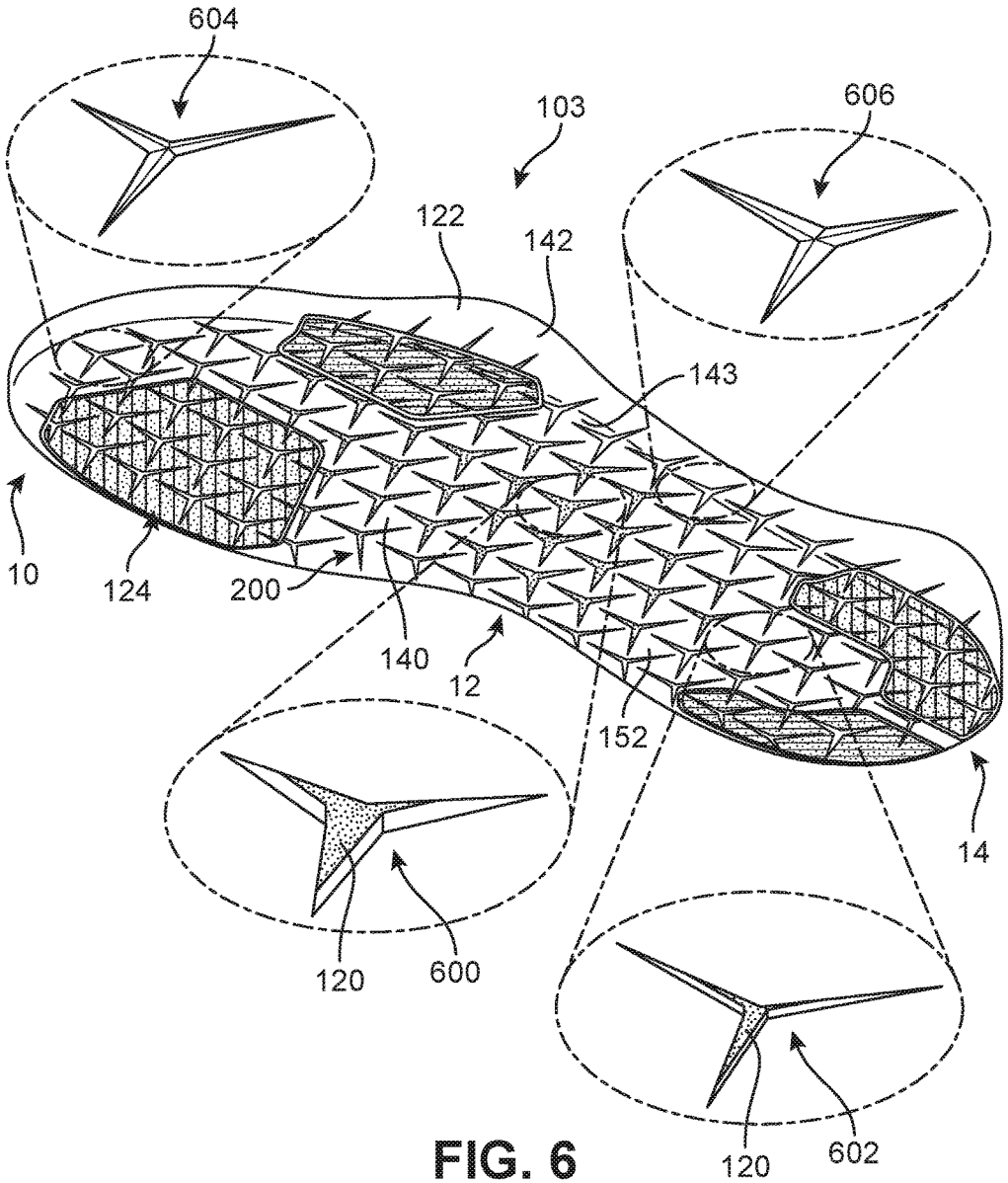
FIG. 6 is a bottom isometric view of an embodiment of a sole structure including blind holes and through holes arranged in an auxetic configuration.
Figure 7:
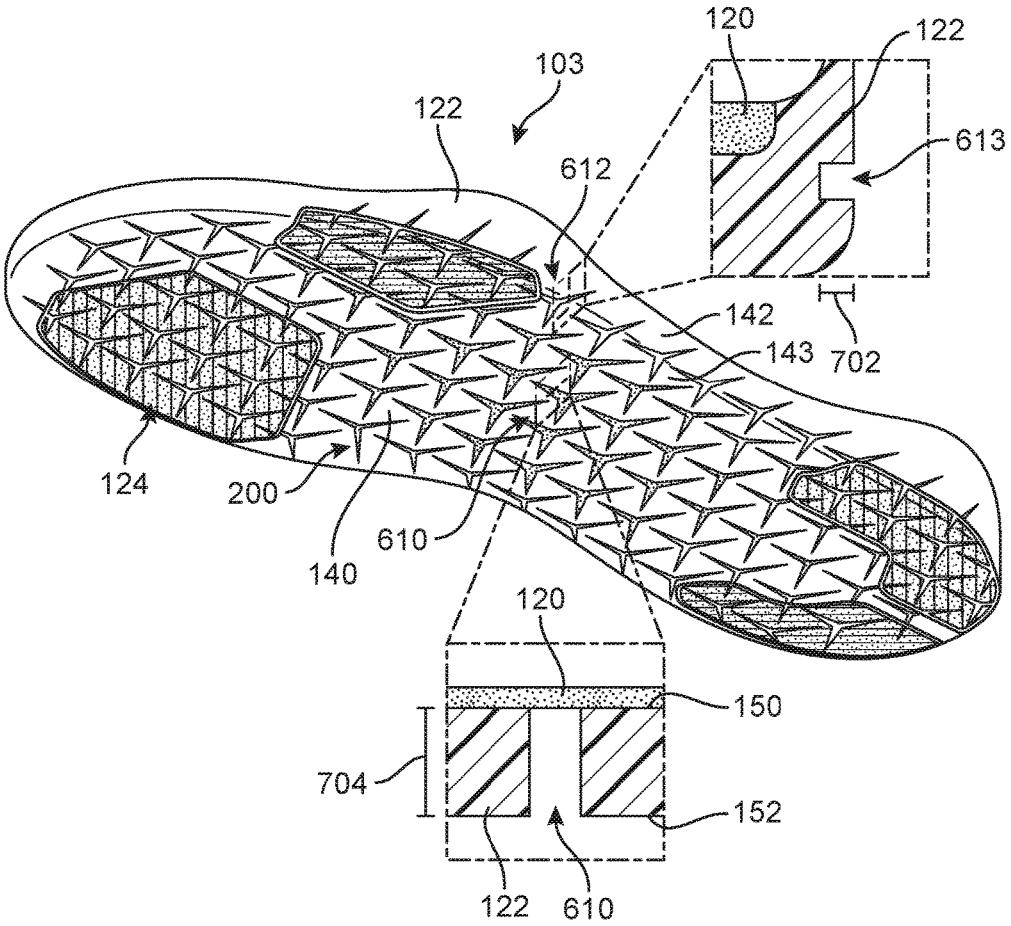
FIG. 7 is a bottom isometric view of an embodiment of a sole structure including blind holes and through holes arranged in an auxetic configuration.

FIG. 6 illustrates a bottom isometric view of an embodiment of sole structure 103, including several enlarged views of representative holes in midsole component 122. FIG. 7 illustrates a bottom isometric view of an embodiment of sole structure 103, including two enlarged cross-sectional views. Referring to FIGS. 6-7, the properties of two or more holes in plurality of holes 200 could vary from one another. Examples of possible variations between two or more holes include, but are not limited to, variations in: the surface area of each hole, hole geometry, hole depth, hole type (e.g., blind hole or through hole), as well as possibly other kinds of variations.

Embodiments may employ through holes, blind holes or both. In some embodiments, a sole structure may be configured to include only through holes. In other embodiments, a sole structure may be configured to include only blind holes. In still other embodiments, a sole structure may include one or more through holes as well as one or more blind holes.

As seen in FIG. 6, the exemplary embodiment includes both through holes and blind holes. As an example, a hole 600 of plurality of holes 200 may be a through hole. Specifically, hole 600 extends fully between outer surface 152 of midsole component 122 and inner surface 150 of midsole component 122. Moreover, in the exemplary view, inner sole component 120 (represented schematically using shading in FIG. 6) is visible through hole 600. As another example, hole 602 of plurality of holes 200 is also a through hole.

Although both hole 600 and hole 602 are through holes, they may differ in other ways including opening size or opening area, location as well as in possibly other ways. In this case, hole 602 has a slightly smaller opening size or opening area than hole 600. Specifically, while the arm portions of hole 600 and hole 602 may be approximately similar in length, the arms of hole 600 are wider than the arms of hole 602 in the non-tensioned configuration, resulting in a larger opening area for the same approximate perimeter size of hole 600 and hole 602. Moreover, hole 602 may be disposed in heel portion 14 of sole structure 103 while hole 600 may be disposed in midfoot portion 12. In other embodiments, hole 600 could have larger arm lengths and/or a larger perimeter length than hole 602.

The full set of through holes comprising part of plurality of holes 200 may be best seen in FIG. 2, where only the through holes are visible on inner surface 150 of midsole component 122. Thus, it may be seen that the through holes of the exemplary embodiment are generally disposed through midfoot portion 12, and in some of heel portion 14 as well as some of forefoot portion 10. Furthermore, as discussed in further detail below, the through holes may generally be located in a central zone of midsole component 122.

Plurality of holes 200 may also include one or more blind holes. For example, in FIG. 6, plurality of holes 200 is seen to include a hole 604, which is a blind hole. Plurality of holes 200 also includes hole 606, which is a blind hole. Here, hole 604 may be disposed at a forward most portion of midsole component 122 while hole 606 may be disposed on a lateral side edge of midsole component 122.

As shown clearly in FIG. 7, holes of plurality of holes 200 could have different depths. For example, a hole 610, which is disposed on lower portion 140 of midsole component 122, is shown having a depth 704. Moreover, hole 610 is shown as a through hole and therefore depth 704 is also equivalent to the thickness of midsole component 122 at the location of hole 610.

FIG. 7 also illustrates a hole 612 with a portion 613 (shown in the enlarged cross-section) disposed in sidewall portion 142. In this case, portion 613 of hole 612 has a depth 702. Moreover, hole 612 is shown as a blind hole and therefore depth 702 is seen to be less than the thickness of midsole component 122 at the location of hole 612.

It may also be appreciated that through holes may differ in depth according to the thickness of the portion of midsole component 122 where each through hole is located. In other words, through holes disposed in thicker portions of midsole component 122 may have different depths than through holes disposed in relatively thinner portions of midsole component 122. Additionally, since blind holes can have thicknesses that are different than the local thickness of midsole component 122, two or more blind holes on midsole component 122 could have different depths.

In different embodiments, outer sole members may also be configured with holes of different types. In the exemplary embodiment shown in FIGS. 6-8, outer sole members 124 have holes that are blind holes. Such a configuration may help limit the auxetic expansion of outer sole members under tension, since blind holes may result in a lesser degree of expansion than similarly configured through holes. However, other embodiments could use one or more through holes on an outer sole member. Moreover, in some cases, such through holes could be continuous with underlying holes in a midsole component (including a blind hole or through hole in the midsole component).

The locations of one or more holes could vary. In some embodiments, holes could be disposed on a lower portion of a midsole component. In other embodiments, holes could be disposed on a sidewall portion of a midsole component. In still other embodiments, holes could be disposed on a lower peripheral portion joining the lower portion and sidewall portion of a midsole component.

As seen in FIGS. 6 and 7, midsole component 122 includes lower portion 140, sidewall portion 142 and a lower peripheral portion 143 that extends around the periphery of lower portion 140 and joins with sidewall portion 142. In the exemplary embodiment, at least some holes of plurality of holes 200 extend through lower peripheral portion 143 and/or sidewall portion 142. For example, hole 612 extends partially through lower peripheral portion 143, while a portion 613 of hole 612 extends onto sidewall portion 142.

By placing holes through each of lower portion 140, lower peripheral portion 143 and sidewall portion 142 of a midsole component 122, each of these portions can be configured to undergo auxetic expansion under tension, thereby allowing for improved traction and flexibility in these portions.

As previously discussed, through holes may tend to expand more, relative to an initial size of the hole, than blind holes of similar geometry and opening size. In auxetic structures, therefore, through holes may provide for a maximum ability of the auxetic material to expand (or compress) in an auxetic matter. In some embodiments, through holes may be used in areas where maximum expansion is sought, while blind-holes may be used in areas where relatively less expansion under tension is desired. In other words, through holes and blind holes can be used in combination on a sole structure to provide differential degrees of expansion according to the desired functionality of different regions of the sole structure.

Figure 8:
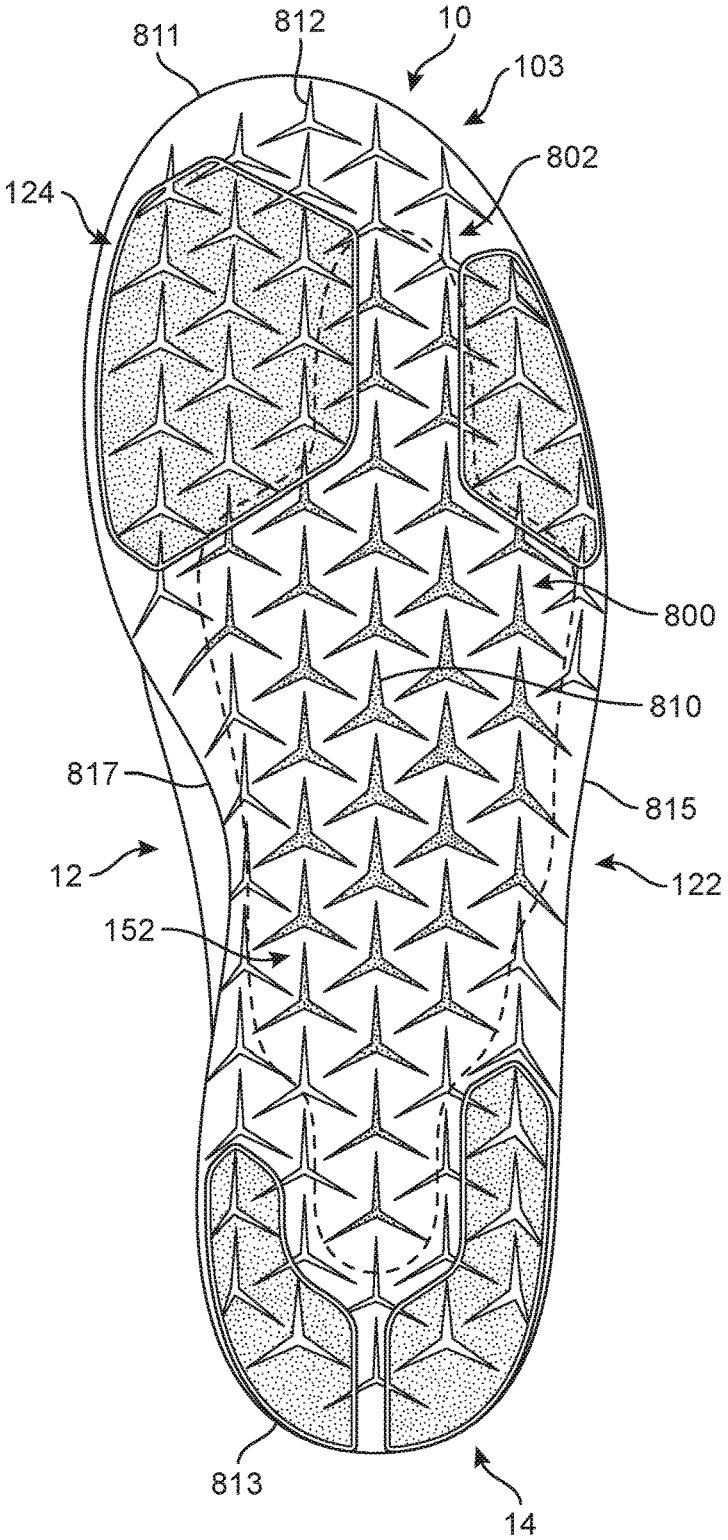
FIG. 8 is a bottom view of an embodiment of a sole structure with holes disposed in two zones.

FIG. 8 illustrates a bottom view of sole structure 103. For purposes of illustrating a possible arrangement of holes on the outer surface 152 of midsole component 122, the bottom of sole structure 103 has been demarcated into two distinct zones, namely a first zone 800 and a second zone 802. Each zone may approximately correspond with a grouping of holes having a common feature, such as depth. Because depth may affect the degree to which a hole expands under tension, holes with similar depths may tend to undergo similar amounts of expansion (or contraction) under tension (horizontal compression).

Here, first zone 800 comprises a central or interior portion of midsole component 122, extending through some of heel portion 14, much of midfoot portion 12 and some of forefoot portion 10. In at least some locations, second zone 802 may be disposed peripherally to first zone 800. First example, second zone 802 may extend forwards of first zone 800 in forefoot portion 10, such that second zone 802 extends to a forward edge 811 of forefoot portion 10. Likewise, second zone 802 may extend rearwardly of first zone 800 in heel portion 14, such that second zone 802 extends to a rearward edge 813 of heel portion 14. In midfoot portion 12, second zone 802 may extend around the periphery of first zone 800, such that second zone 802 is disposed on some of lateral side edge 815 of midsole component 122 as well as on some of medial side edge 817 of midsole component 122.

In the exemplary embodiment, holes in first zone 800 may be through holes while holes in second zone 802 may be blind holes. In other words, holes in first zone 800 may extend all the way through midsole component 122. For example, a first hole 810 in first zone 800 is a through hole that extends from outer surface 152 of midsole component 122 to inner surface 150. In contrast, second hole 812 in second zone 802 is a blind hole. In this case, second hole 812 may only extend partially through midsole component 122 and may not be open on inner surface 150 of midsole component 122.

Figure 9:
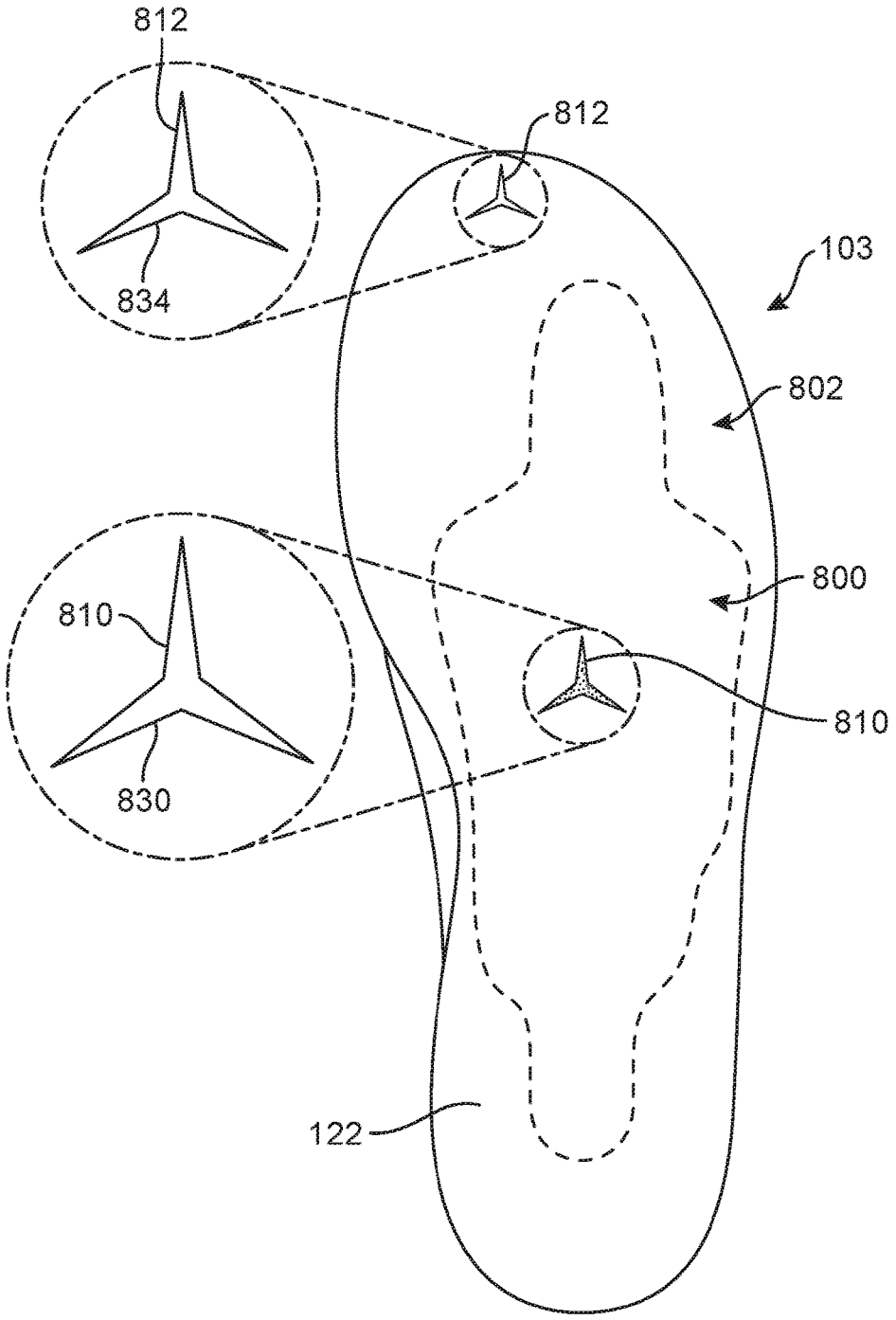
FIGS. 9-10 illustrate auxetic expansion of two different holes on an embodiment of a sole structure.
Figure 10:
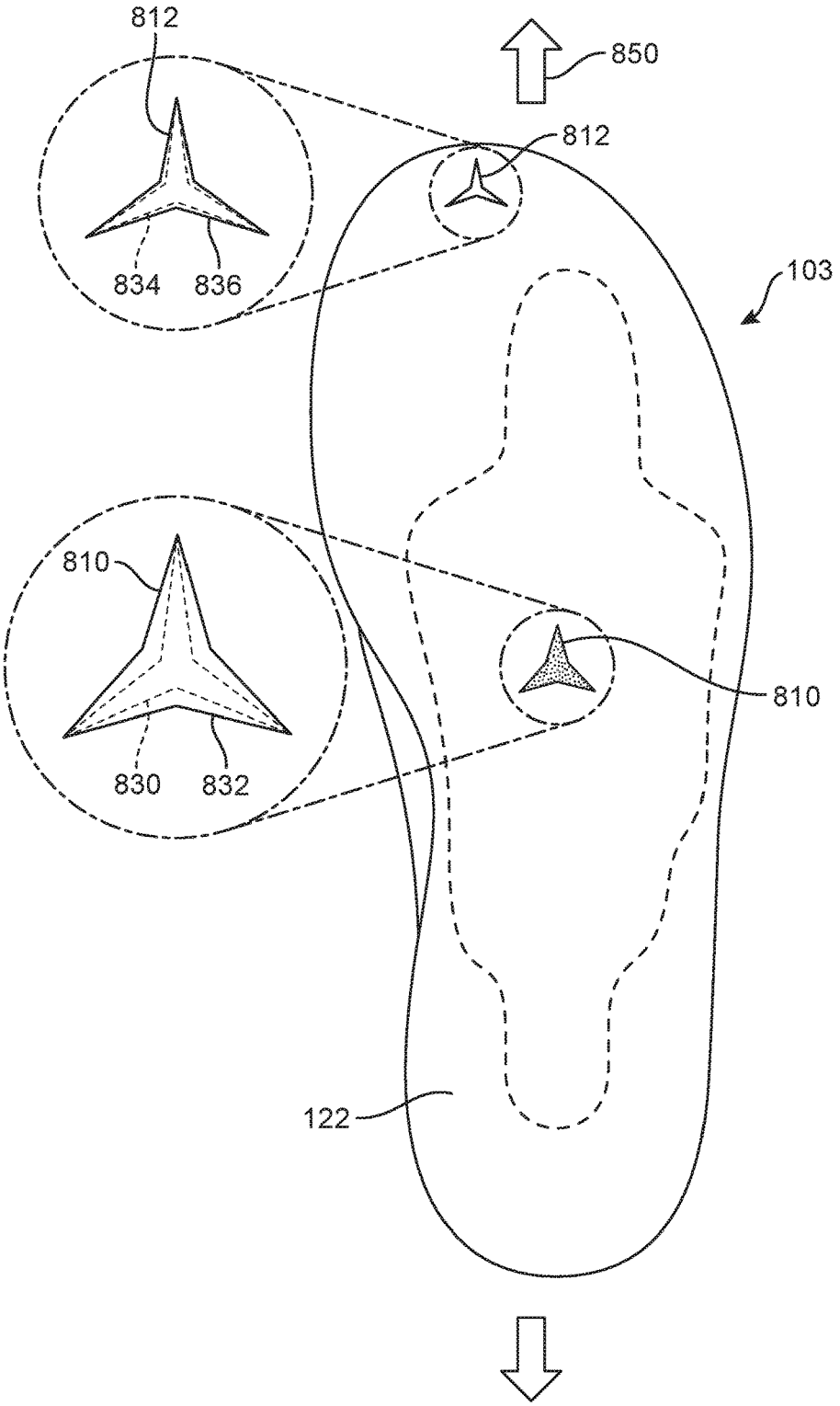

As shown schematically in FIGS. 9 and 10, through holes may generally undergo a greater degree of expansion as midsole component 122 (and sole structure 103 as a whole) is deformed auxetically. For purposes of illustration, only the representative first hole 810 and second hole 812 are shown in FIGS. 9-10. It will be understood that the behavior of first hole 810 may generally be representative of the other holes in first zone 800, while the behavior of second hole 812 may generally be representative of the other holes in second zone 802.

As seen in FIGS. 9-10, a tension 850 may be applied to sole structure 103 to expand sole structure 103. Here it will be understood that tension 850 is applied in a single linear direction, but the auxetic nature of sole structure 103 causes the sole structure 103 (including midsole component 122 and outer sole members 124) to expand uniformly in the horizontal direction.

In the exemplary embodiment, first hole 810 is shown to expand from an initial opening size 830 to an expanded opening size 832 under the application of tension 850 to sole structure 103. In addition, second hole 812 is shown to expand from initial opening size 834 to expanded opening size 836 under application of tension 850. As clearly shown in FIGS. 9-10, first hole 810 undergoes a larger degree of expansion than second hole 812, since first hole 810 is a through hole. Specifically, the ratio of expanded opening size 832 to initial opening size 830 is greater than the ratio of expanded opening size 836 to initial opening size 834.

By providing through holes in a central region of a sole structure with blind holes around the periphery of the sole structure, the degree of auxetic expansion through the sole structure can be varied and controlled. In particular, through holes in the center of the sole structure allow for a greater degree of expansion through much of the midfoot and arch, as well as some of the forefoot adjacent to the midfoot, thereby allowing for increased flexibility of those regions under tension. In contrast, the peripheral regions of the sole structure may include blind holes to provide some auxetic expansion for increasing surface area and improving traction. However, at the periphery it may not be desirable to have the level of expansion occurring in the midfoot and adjacent regions as too much flexibility in the periphery of the sole structure could reduce stability.

Figure 11:
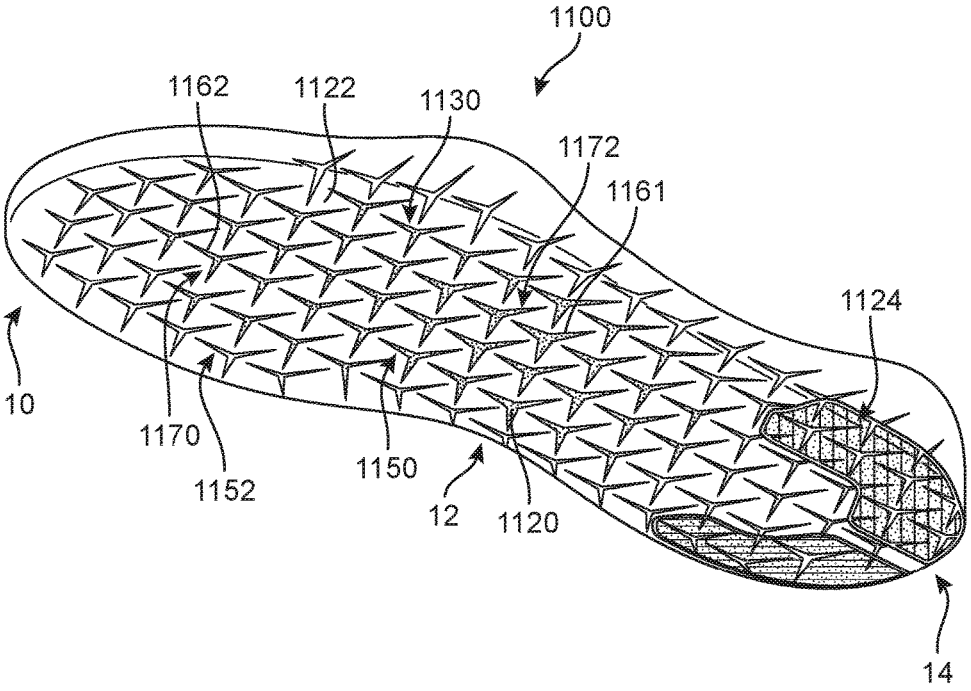
FIGS. 11-12 illustrate an embodiment of a sole structure before and while a compressive force is applied.
Figure 12:
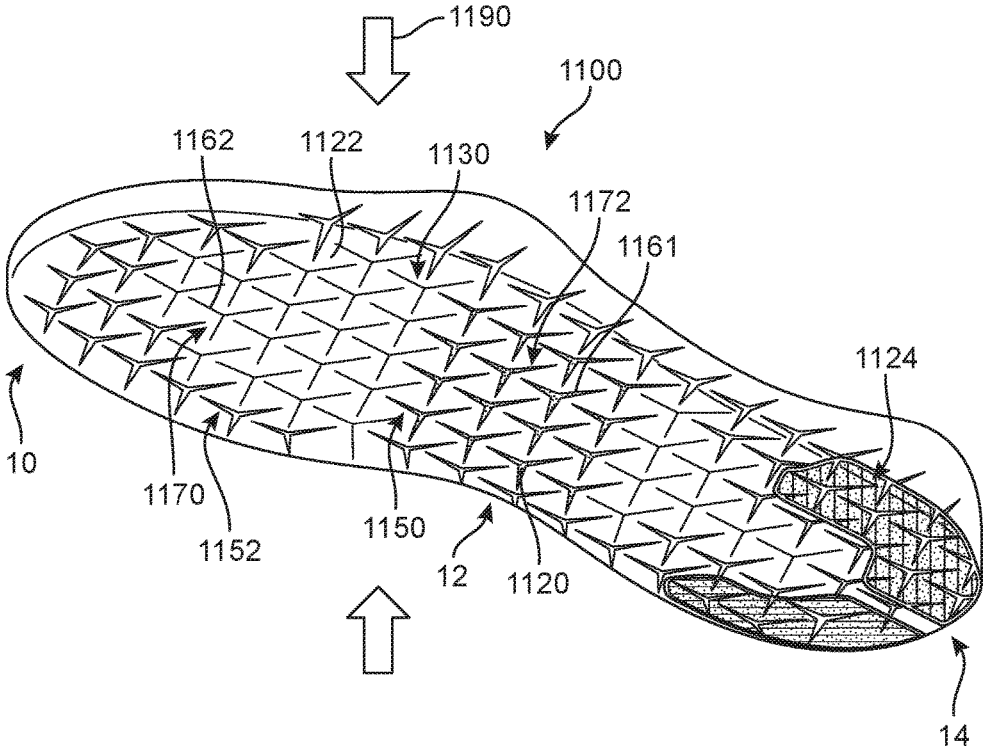

FIGS. 11 and 12 illustrate bottom isometric views of another embodiment of a sole structure 1100. Specifically, FIG. 11 illustrates a bottom isometric view of sole structure 1100 in an un-compressed state, while FIG. 12 illustrates a bottom isometric view of sole structure 1100 in a compressed state. Specifically, FIG. 12 shows sole structure 1100 deforming under vertically oriented compression forces 1190 (i.e., forces generally perpendicular to the sole surface, or to the longitudinal and lateral directions of the sole). For purposes of clarity the present embodiment includes outer sole members 1124 in heel portion 14, but not forefoot portion 10 of sole structure 1100.

As with previous embodiments, sole structure 1100 includes midsole component 1122 and an inner sole component 1120 (visible through holes). Midsole component 1122 further includes a plurality of holes 1130 arranged in an auxetic configuration, which also extend into outer sole members 1124.

In the embodiment of FIGS. 11 and 12, plurality of holes 1130 includes a group of through holes 1150 and a group of blind holes 1152, which generally surround the ground of through holes 1150. Further, plurality of through holes 1150 is comprised of holes of different opening sizes. For example, a first hole 1161 disposed in midfoot portion 12 has a larger opening size or cross-sectional area than a second hole 1162 in forefoot portion 10.

In some embodiments, compressing a sole structure with holes arranged in an auxetic configuration can act to close the holes of the sole structure as the sole portions around the holes expand under compression. As seen, for example, in FIG. 12, the opening size or cross-sectional area of holes 1150 decreases during the application of compression forces 1190. In this case, some holes may completely close (e.g., second hole 1162) while other holes may only partially close (e.g., first hole 1161).

Using the exemplary configuration, sole structure 1100 may be configured to stiffen in some areas under vertical compression. For example, a first set of holes 1170 in forefoot portion 10 may collapse or close under compression, thereby creating a continuous forefoot portion 10 for sole structure 1100 that may be more stiff than the non-compressed configuration of forefoot portion 10. In contrast, a second group of holes 1172 in midfoot portion 12 may decrease in opening size, but may not fully close, thereby allowing for increased flexibility over forefoot portion 10. This kind of configuration may be useful in providing increased support for a forefoot as the forefoot contacts the ground (requiring firm support) while the arch remains bent (and therefore requires flexibility).

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

What is claimed is:

1. An article of footwear, comprising:

a midsole component having an inner surface and an outer surface, and including a plurality of holes extending from the outer surface;

wherein the plurality of holes are arranged to provide the midsole component with an auxetic configuration such that when the midsole component is tensioned in a first direction, the midsole component expands in both the first direction and in a second direction that is orthogonal to the first direction;

wherein the plurality of holes includes a plurality of through holes and a plurality of blind holes, wherein each through hole extends through the midsole component and through both the inner surface and the outer surface, and wherein each blind hole extends through a portion of the midsole component; and an outer sole member having an inner surface and an outer surface, the outer sole member affixed to the midsole component such that the inner surface of the outer sole member abuts the outer surface of the midsole component, and wherein the outer sole member includes a blind hole extending from the outer surface of the outer sole member toward the inner surface of the outer sole member.

2. The article of footwear of claim 1, wherein the outer sole member extends into at least one of the plurality of through holes.

3. The article of footwear of claim 1, wherein the blind hole of the outer sole member extends into the at least one of the plurality of through holes.

4. The article of footwear of claim 1, wherein the plurality of through holes are surrounded by the plurality of blind holes in the midsole component.

5. The article of footwear of claim 1, wherein each of the plurality of through holes and each of the plurality of blind holes in the midsole component has a tri-star shape.

6. The article of footwear of claim 1, wherein each of the plurality of through holes has a tri-star shape.

7. The article of footwear of claim 1, wherein the outer sole member is a first outer sole member, the article of footwear further comprising a second outer sole member;

wherein the second outer sole member has an inner surface and an outer surface, and is affixed to the midsole component such that the inner surface abuts the outer surface of the midsole component.

8. The article of footwear of claim 7, wherein the second outer sole member includes a blind hole extending from the outer surface.

9. The article of footwear of claim 7, wherein the midsole component has a forefoot portion, a midfoot portion, and a heel portion; and wherein the first outer sole member is affixed to the forefoot portion of the midsole component, and wherein the second outer sole member is affixed to the heel portion of the midsole component.

10. An article of footwear, comprising:

a midsole component having an inner surface and an outer surface, and including a plurality of holes extending from the outer surface;

wherein the plurality of holes are arranged to provide the midsole component with an auxetic configuration such that when the midsole component is tensioned in a first direction, the midsole component expands in both the first direction and in a second direction that is orthogonal to the first direction;

wherein the plurality of holes includes at least a first hole and a second hole;

wherein the first hole is a through hole that extends through the midsole component and through both the inner surface and the outer surface;

wherein the second hole is a blind hole that extends into the midsole component from the outer surface; and wherein when the midsole component is tensioned in either the first direction or the second direction, the through hole expands more than the blind hole; and an outer sole member having an inner surface and an outer surface, the outer sole member affixed to the midsole component such that the inner surface of the outer sole member abuts the outer surface of the midsole component.

11. The article of footwear of claim 10, wherein the outer sole member extends into the first hole of the midsole component.

12. The article of footwear of claim 10, wherein the outer sole member includes a blind hole extending from the outer surface.

13. The article of footwear of claim 12, wherein the blind hole of the outer sole member extends into the first hole of the midsole component.

14. The article of footwear of claim 10, wherein the outer sole member is a first outer sole member, the article of footwear further comprising a second outer sole member;

wherein the second outer sole member has an inner surface and an outer surface, and is affixed to the midsole component such that the inner surface abuts the outer surface of the midsole component.

15. The article of footwear of claim 14, wherein the midsole component has a forefoot portion, a midfoot portion, and a heel portion; and wherein the first outer sole member is affixed to the forefoot portion of the midsole component, and wherein the second outer sole member is affixed to the heel portion of the midsole component.

16. The article of footwear of claim 10, wherein the first hole and the second hole each have a tri-star shape.

* * * * *